US007896782B2

(12) United States Patent
Tamari et al.

(10) Patent No.: US 7,896,782 B2
(45) Date of Patent: Mar. 1, 2011

(54) EXERCISING MACHINE

(76) Inventors: Ran Tamari, Hod-Hasharon (IL); Herzel Frenkel, Ashdod (IL)

( * ) Notice: Subject to any disclaimer, the term of this patent is extended or adjusted under 35 U.S.C. 154(b) by 0 days.

(21) Appl. No.: 12/044,984

(22) Filed: Mar. 9, 2008

(65) Prior Publication Data

US 2009/0227428 A1 Sep. 10, 2009

(51) Int. Cl.
*A63B 22/06* (2006.01)
*A63B 69/16* (2006.01)

(52) U.S. Cl. ..... 482/57

(58) Field of Classification Search ..... 482/51–53, 482/57, 62, 70–71; 280/259–260; 74/594.1–594.3; *A63B 22/06, 69/16*
See application file for complete search history.

(56) References Cited

U.S. PATENT DOCUMENTS

| | | | | |
|---|---|---|---|---|
| 3,865,366 | A | 2/1975 | Stantial | |
| 4,098,502 | A | 7/1978 | Faust | |
| 4,854,578 | A | 8/1989 | Fulks et al. | |
| 5,242,343 | A | 9/1993 | Miller | |
| 5,261,294 | A | 11/1993 | Ticer et al. | |
| 5,277,684 | A | 1/1994 | Harris et al. | |
| 5,383,829 | A | 1/1995 | Miller et al. | |
| 5,433,680 | A * | 7/1995 | Knudsen | 482/57 |
| 5,779,598 | A | 7/1998 | Lee et al. | |
| 5,833,583 | A * | 11/1998 | Chuang | 482/60 |
| 5,916,065 | A | 6/1999 | McBride et al. | |
| 6,027,429 | A | 2/2000 | Daniels et al. | |
| 6,099,439 | A | 8/2000 | Ryan et al. | |
| 6,146,313 | A | 11/2000 | Whan-Tong et al. | |
| 6,159,132 | A | 12/2000 | Chang et al. | |
| 6,171,217 | B1 | 1/2001 | Cutler et al. | |
| 6,206,804 | B1 * | 3/2001 | Maresh | 482/52 |
| 6,227,055 | B1 | 5/2001 | Pitzer et al. | |
| 6,277,056 | B1 | 8/2001 | McBride et al. | |
| 6,334,836 | B1 * | 1/2002 | Segasby | 482/4 |
| 6,416,442 | B1 | 7/2002 | Steams et al. | |

(Continued)

OTHER PUBLICATIONS

The Merriam-Webster Dictionary, definition of "wheel", http://www.merriam-webster.com/dictionary/wheel.*

*Primary Examiner* — Loan H. Thanh
*Assistant Examiner* — Oren Ginsberg

(57) ABSTRACT

The subject matter discloses an exercising device enabled to switch between elliptical course and circular course of footrests used by a user, comprising two main wheels, each connected to a different footrest; two connecting rods, the distal end of each connecting rod is connected to each main wheel and the proximal end of each connecting rod is connected to the body of the exercising device, said connecting rods are enabled to move the two main wheels on a horizontal axis.
The subject matter also discloses a mechanism within an exercising device enabling both elliptical and circular movement of a footrest in the exercising device, the mechanism comprising: a main wheel connected to the footrest and rotated upon movement of the footrest; a connecting rod connected on its proximal end to the body of the exercising device and on its distal end to the main wheel; wherein the course of the footrest's movement is elliptical when the distal end is connected to a non-centric position on the main wheel and circular when the connecting rod is connected to a centric position on the main wheel or when the connecting rod is not connected to both the main wheel and the body of the exercising device.
The footrests and handlebars of the exercising device fit the new motions enabled by the device. A stepper can also be embedded within the exercising device of the disclosed subject matter.

8 Claims, 8 Drawing Sheets

U.S. PATENT DOCUMENTS 6,482,130 B1 11/2002 Pasero et al.
6,551,217 B2 4/2003 Kaganovsky et al.
6,605,021 B2 * 8/2003 Kobayashi et al. ..... 482/57
6,648,800 B2 11/2003 Stearns et al.
6,672,992 B1 1/2004 Lo et al.
6,672,994 B1 1/2004 Stearns et al.
6,685,598 B1 2/2004 Rufino et al.
6,689,020 B2 2/2004 Stearns et al.
6,749,540 B1 6/2004 Pasero et al.
6,802,798 B1 * 10/2004 Zeng ..... 482/57
6,827,676 B2 12/2004 Kuo
6,939,271 B1 9/2005 Whan-Tong et al.
7,163,491 B2 1/2007 Rufino
7,288,048 B2 10/2007 Lin
2004/0180760 A1 9/2004 Rufino et al.
2005/0009668 A1 1/2005 Savettiere et al.
2005/0130810 A1 6/2005 Sands et al.
2005/0245358 A1 11/2005 Mercado et al.
2005/0245365 A1 11/2005 Rolli
2006/0247095 A1 11/2006 Rummerfield
2007/0099762 A1 * 5/2007 Stevens ..... 482/52
2007/0298935 A1 * 12/2007 Badarneh et al. ..... 482/52
2008/0051258 A1 * 2/2008 Schmehl et al. ..... 482/52

* cited by examiner

EXERCISING MACHINE

BACKGROUND OF THE INVENTION

1. Technical Field

The present disclosure relates to exercise equipments in general, and to a method and device for stationary striding and riding exercise devices in particular.

2. Discussion of the Related Art

Various types of exercise equipment are used for aerobic exercise. For example, cross-country skiing exercise devices that simulate the gliding motion of cross-country skiing, elliptical machines, treadmills, stationary bicycle exercise device and others. Some of these devices may apply a high amount of pressure on joints in case they are used solely for long durations. Additionally, some exercising devices require more power and are hard to use for long durations.

A person planning an exercise program would desire to build up different muscles or several groups of muscles. This may be achieved by working on different exercise devices. For example, the hamstrings group of muscles can be strengthened using the stationary bicycle, and other muscles are activated when using an elliptical exercise device.

One of the main challenges in exercising is to attract users to keep exercising for a long time, and to spend more time during each training session. Hence, for example, it is recommended to enable users to switch exercising devices during training, for example use a stepper device for 20 minutes and then ride the stationary bicycle for another 20 minutes. To achieve this goal a user would have to switch exercise machines with little rest between sessions. Due to overcrowding of gyms, the typical user would likely have to wait a substantial amount of time for the second or third exercise machine. When planning a gym, space is allocated for aerobic training. Each section in the aerobic area of the gym is allocated for another device, such as stationary bicycles, treadmills, steppers and others. In many cases, many of the devices are not used while users wait for other devices and space in the gym is wasted. Further, when a person establishes a private gym at home, he is required to purchase several aerobic devices to work on a variety of muscles.

SUMMARY OF THE PRESENT INVENTION

It is an object of the present invention to provide an apparatus that enables a person to exercise in a variety of aerobic exercises. Such device provides both circular and elliptical motion of a footrest moved or pedaled by the user of the device. The exercising device provides circular motion provided by a stationary bicycle and elliptical motion provided by an elliptical exercising device.

It is another object of the subject matter to disclose an exercising device enabled to switch between elliptical course and circular course of footrests used by a user, comprising: two main wheels, each connected to a different footrest; at least one connecting rod connected to the two main wheels, said at least one connecting rod is enabled to move the two main wheels on a horizontal axis. In some embodiments of the subject matter, the at least one connecting rod is at least two connecting rods.

In some embodiments of the subject matter, the distal end of each of the at least two connecting rods is connected to each main wheel and the proximal end of each of the at least two connecting rods is connected to the body of the exercising device. In some embodiments of the subject matter, the exercising device further comprises a power-generating module for maneuvering the at least one connecting rods.

In some embodiments, the exercising device further comprises a control unit for controlling the movement of the at least one connecting rods. In some embodiments, controlling the movement of the at least one connecting rod is performed mechanically. In some embodiments, the footrest is folded when the course of the footrest's movement is circular and unfolds when the course of the footrest's movement is elliptical. In some embodiments, the footrest is a pedal.

In some embodiments, the control unit determines parameters selected from a group consisting of the amplitude, velocity, frequency and phase of the at least one connecting rod's movement. In some embodiments, the exercising device further comprising two interconnected secondary wheels, each secondary wheel is limited to vertical movement and connected to a different main wheel, wherein both secondary wheels are in the same height.

In some embodiments, the two interconnected secondary wheels affix the two main wheels in the same distance from the center of the range of the horizontal movement of the main wheels. In some embodiments, the movement of the footrests is elliptical when the two main wheels are moved on the horizontal axis and circular when the two main wheels are not moved on the horizontal axis. In some embodiments, the distal end of the at least one connecting rod is connected to the center of the main wheel.

It is another object of the subject matter to disclose a mechanism within an exercising device enabling both elliptical and circular movement of a footrest in the exercising device, the mechanism comprising: a main wheel connected to the footrest and rotated upon movement of the footrest; a connecting rod connected on its proximal end to the body of the exercising device and on its distal end to the main wheel; wherein the course of the footrest's movement is elliptical when the distal end is connected to a non-centric position on the main wheel and circular when the connecting rod is connected to a centric position on the main wheel or when the connecting rod is not connected to both the main wheel and the body of the exercising device. In some embodiments, the mechanism further comprising a secondary wheel for synchronizing the movement of the main wheel to the movement of another main wheel connected to another footrest.

It is another object of the subject matter to disclose a mechanism for changing the surface area of a footrest while exercising, comprising: a footrest composed of at least two surfaces connected serially; a rotation axis connected to at least one of the surfaces such that at least one surface rotates on the rotation axis and folds on or beneath another surface. In some embodiments, the footrest rotates within said rotation axis such that the surface of said pedal may be parallel to the vertical or horizontal axes. In some embodiments, the mechanism further comprises a locking mechanism for securely holding the pedal perpendicular to the ground.

It is another object of the subject matter to disclose a handlebar for an exercising device enabling both elliptical and circular range of movement of a footrest, wherein the handlebar is immobile in case of circular course and move in case of elliptical course. In some embodiments, the handlebar comprises two portions, each associated with a different footrest, wherein the movement of each portion of the handlebar is a function of the movement of the associated footrest.

It is another object of the subject matter to disclose a method for providing elliptical movement of a device connected to a wheel, the method comprising rotating the device connected to the wheel on the course of movement of the to wheel; and moving the wheel in a linear course.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are designated by the same numerals or letters.

DETAILED DESCRIPTION OF THE PREFERRED EMBODIMENT

Figure 1:
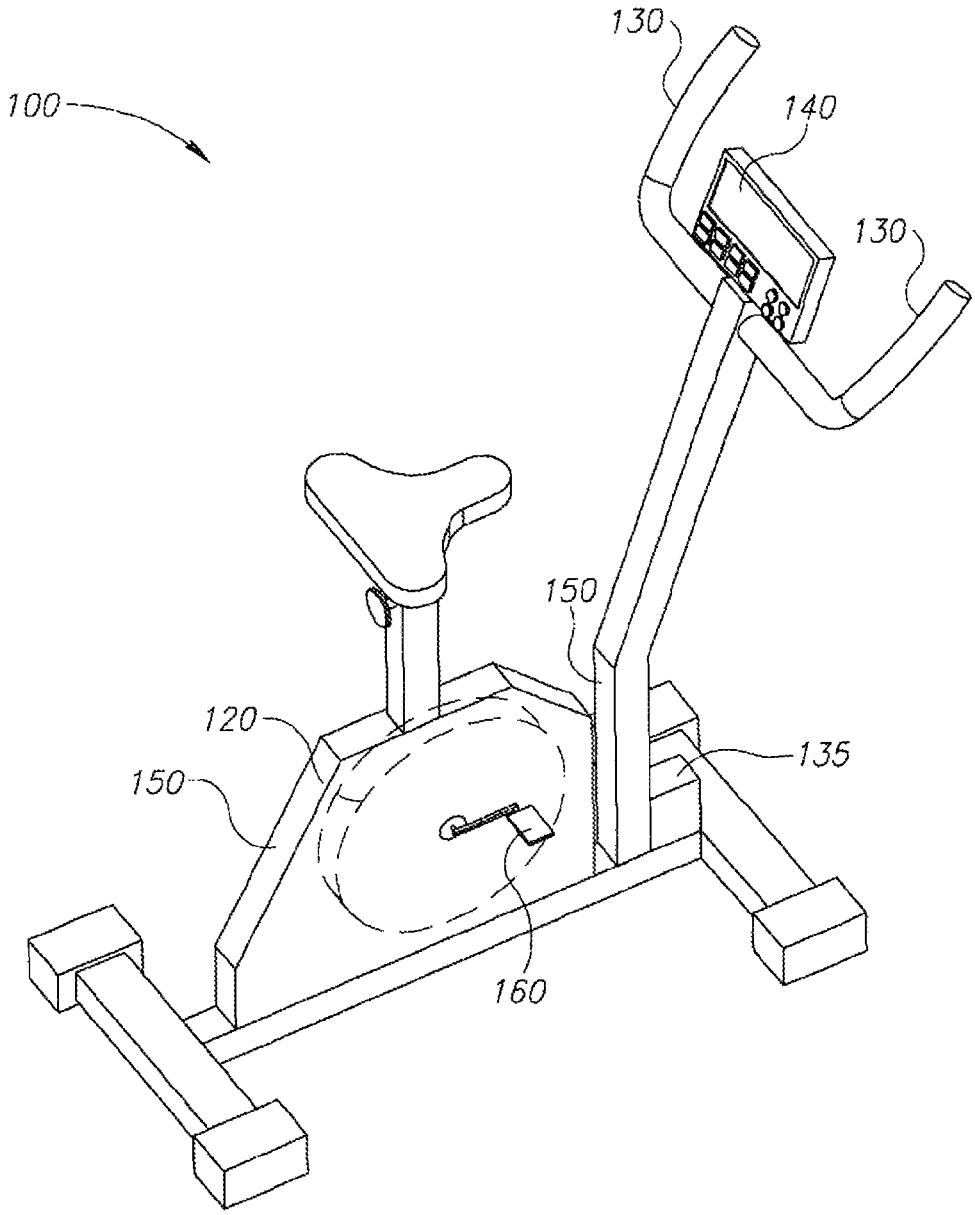
FIG. 1 illustrates an exercising device enabled to allow both elliptic and linear motion, in accordance with an exemplary embodiment of the disclosed subject matter.

One technical problem dealt with in the disclosed subject matter is to enable a person to perform various exercises on a single exercising device. Such problem is especially acute in aerobic exercise device. The device of the present subject matter enables both circular and elliptical movement of footrests pedaled by the user.

More specifically, stationary bicycle exercise devices require circular movement and elliptical devices require generally elliptical movement of the footrests. Hence, novel and unobvious mechanism is desired to enable smooth to switch between elliptical movement and circular movement performed by pedals or footrests of an exercise device.

In accordance with one embodiment of the present subject matter, suggested in the subject matter is a mechanism that enables and controls both linear and circular movement of wheels within the exercise device. To control both the linear and circular movement of the wheels, the mechanism comprises two pairs of synchronized wheels, each pair of the synchronized wheels comprises a main wheel and a secondary wheel.

The main wheel is limited to linear movement on a horizontal axis and maneuvered by a connecting rod connected thereto. In an exemplary embodiment of the subject matter, the connecting rod is connected to a non-centric position on the main wheel, preferably on the distal end, and to the body of the exercise device preferably on the proximal end.

In an exemplary embodiment of the subject matter, the proximal end of the connecting rod is connected to a power-generating device, which moves said connecting rod and generates the linear movement of the main wheel.

The footrest or pedal on which the users place their feet is connected to the main wheel, preferably on opposite locations on the main wheels. For example, when one footrest is on a topmost point of one main wheel, the other footrest is located at the lowest position on the radial course on the second main wheel.

In accordance with a preferred embodiment of the present subject matter, the position of the main wheel relative to the body of the exercising device varies according to the pedaling performed by the user. Thus, by rotating the main wheel and having a fixed length connecting rod, the main wheel is driven by the pedaling motion backwards and forwards relative to the body of the exercising device. In other words, the location of the distal end on the main wheel changes when the user pushes the footrest that rotates the main wheel.

Since the proximal end of the connecting rod is fixed, and the distance between the proximal end of the connecting rod and the distal end of the connecting rod is constant, movement of the distal end of the connecting rod along the circular vector results in linear, preferably forward and backward, horizontal movement of the main wheel. The linear horizontal movement combined with the circular movement caused by pushing the footrest creates an elliptical range of movement of the circulating footrest.

In accordance with another exemplary embodiment of the subject matter, termination of the horizontal movement is performed by positioning the distal end of the connecting rod on the center of the main wheel. Thus, the footrest movement is solely circular as required when using a stationary bicycle exercise device. The movement of the connecting rod may be controlled by a control unit connected to the exercising device and controls a power-generating module that moves the connecting rod.

Each secondary wheel is connected to the respective main wheel, preferably using a rod connected to the central axis of the main wheel and to the central axis of the secondary wheel. In another exemplary embodiment, both the main wheels and the secondary wheels are cogwheels or strap wheels, such that circular movement of the main wheel caused by the user rotating the footrests generates circular movement of the secondary wheel connected to the respective circulating main wheel. A pole interconnects both secondary wheels, such that the height of both secondary wheels is substantially the same. Since both secondary wheels are required to be on substantially the same height, the distance of both main wheels from the center of the course of movement of the main wheels is preferably substantially the same. Thus, both secondary wheels are synchronized and the movement of both main wheels is also synchronized. In another exemplary embodiment, both main wheel and secondary wheel are gears constantly connected to each other.

According to another exemplary embodiment of the disclosed subject matter, only one connecting rod is connected to both main wheels. In such case, the connecting rod is also connected to the exercising device or to a power generating module that maneuvers the connecting rod in a manner that the locations of the two main wheels changes on the horizontal axis. For example, the right main wheel is positioned closer to the seat than the left main wheel, and the movement forced on the connecting rod maneuvers the main wheels in a manner that the left main wheel is closer to the seat than the right main wheel.

FIG. 1 schematically illustrates exercising device 100 enabled to allow is both elliptic and linear motion, in accordance with an exemplary embodiment of the disclosed subject matter. Exercising device 100 comprises a mechanism 120 for controlling the range of movement of both footrests 160, (162 of FIG. 2B). In some exemplary embodiments of the present subject matter two footrests 160, 162 are connected to mechanism 120, such that changing the movement or the range of movement of mechanism 120 changes the range of movement of footrests 160, 162 and thus, change the range of movement of the user's feet when exercising. For example, when the mechanism is locked for linear movement, as detailed below, the only movement enabled to footrests 160, 162 is circular movement, as required for biking.

Footrests 160, 162 may be pedals, shoe like apparatuses for mounting a shoe within or any surface adaptive for placing the foot during exercising. Footrests 160, 162 may be folded towards the body of mechanism 120, to enable to the user to smoothly switch from biking, when a narrow footrest is required, to skiing or using exercising device 100 as an elliptical, when a wide footrest is required. The folding of footrests 160, 162 may be performed by pneumatic force or using an engine, and is described in details in FIGS. 5A and 5B.

Exercising device 100 further comprises handlebars 130, preferably held by the user when using exercising device 100 as an elliptical or as a cross-country skiing device. Handlebars 130 may be assembled as an elongated substantially horizontal rod held by the user on both sides. Alternatively, two or more unattached members may assemble handlebars 130; each of the members is connected to body 150 independently. In another exemplary embodiment of the subject matter, each handlebar is connected to another footrest or to an element in to mechanism 120 disclosed in FIG. 2A. In such case, the handlebar attached to the footrest or the element in mechanism 120 moves according to the member connected thereto. For example, when the footrest ascends, handlebars 130 ascend.

Exercising device 100 further comprises control unit 140 used by the user for determining parameters related to the training. For example, determine the level of intensity, speed, climbing angle, durations of each type of exercising, such as running, skiing and the like. Control unit 140 may also control or enable the user to determine the parameters related of the horizontal movement of the main wheels (230, 260, disclosed in FIG. 2A), such as amplitude, velocity, frequency, phase, phase offset respective to the movement of footrests 160, 162 and the like. Control unit 140 comprises input device such as a plurality of buttons, touch screens, switches, microphones, and the like. In some embodiments, the user may control the range of movement of the main wheels (230, 260, disclosed in FIG. 2A) or switch the type of exercise by moving connecting rods (210, 215 disclosed in FIG. 2A) protruding from body 150 or protruding from handlebars 130. Such connecting rods (210, 215 disclosed in FIG. 2A) is in communication with mechanism 120, and regulates the movement of the wheels (230, 260, disclosed in FIG. 2A) within mechanism 120, thus changing the range of movement of footrests 160, 162.

In an exemplary embodiment of the subject matter, the user may switch exercising type by pressing an electronic button or a switch in control unit 140. Such switch or button activates a command transmitted to a controller (not shown) located within or communicating with mechanism 120. The controller (not shown) is preferably connected to a power generating device (not shown) connected to the connecting rods (210, 215 disclosed in FIG. 2A) and moves the connecting rods (210, 215 disclosed in FIG. 2A) in a manner that generates linear horizontal movement of at least one wheel in mechanism 120. As a result, the command inputted to control unit 140 may connect connecting rods (210, 215 disclosed in FIG. 2A) to main wheels (230, 260, disclosed in FIG. 2A) and generate a linear movement of at least one main wheel in mechanism 120. Other results of actions controlled by control unit 140 may be stopping such linear movement, changing the phase between the linear and circular movement to create a new range of movement, changing the amplitude or velocity of the linear movement, and the like. Switching exercising type, such as switching from biking to skiing, may be performed mechanically, pneumatically, hydraulically, electronically, or combination thereof.

Exercising device 100 preferably comprises or connected to a detecting element 135 for enabling control of the movement of the connecting rods (210, 215 disclosed in FIG. 2A) and synchronization of the movement of connecting rods (210, 215 disclosed in FIG. 2A) relative to the circular movement of footrests 160, 162 generated by the user. Detecting element 135 preferably detects parameters such as the speed, time, frequency, energy, weight, power applied by the user, and the like. Such parameters may be transmitted to controller (not shown) that preferably control the horizontal movement of the distal end of the connecting rods (210, 215 disclosed in FIG. 2A) and as a result regulates the horizontal movement of the main wheels (230, 260, disclosed in FIG. 2A). The parameters may be transmitted to controller (not shown) from a local or remote computer or similar electronic device allowing a remote trainer, either personal or virtual, to control the movement of main wheels. Said movement may also be controlled according to a predetermined schedule, for example different exercise in different times of a day.

Figure 2A:
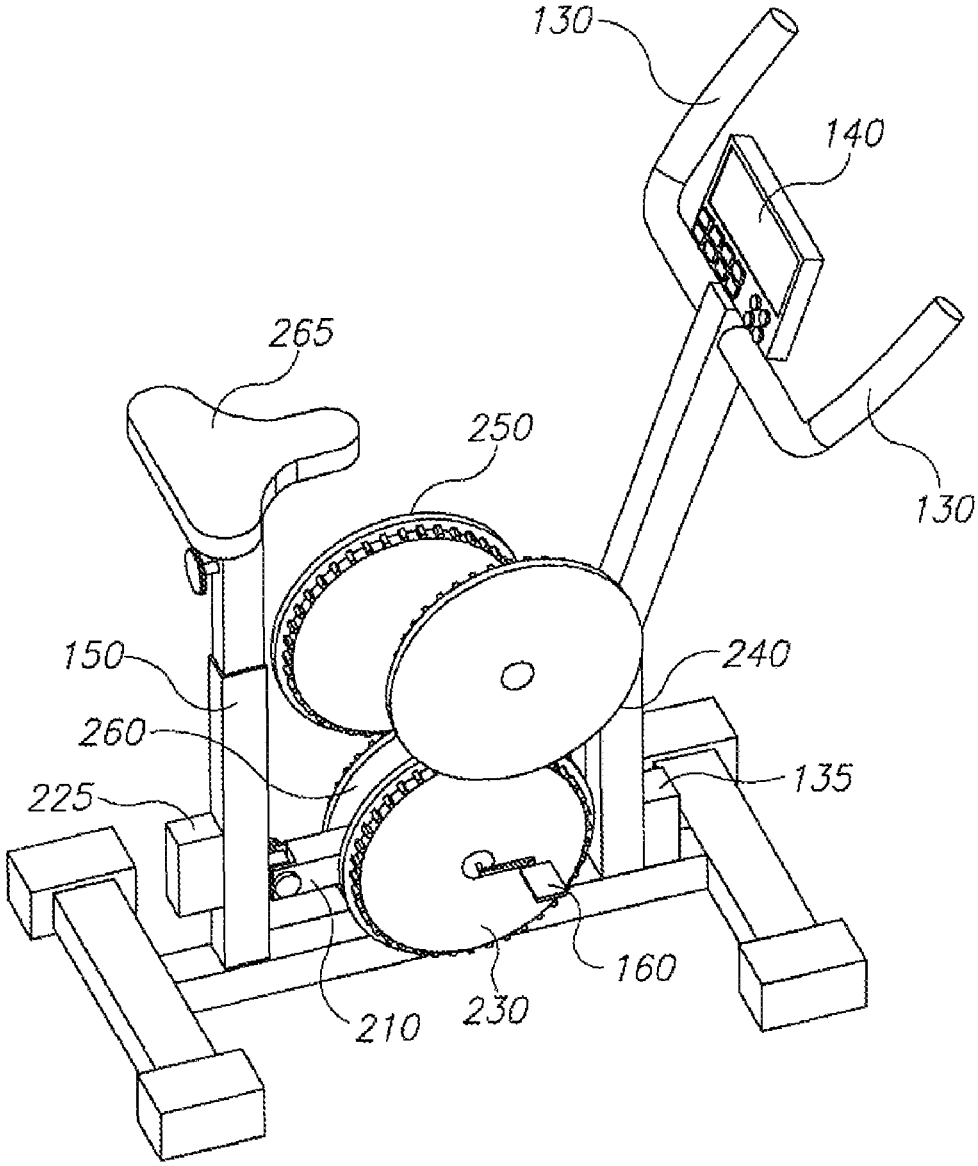
FIG. 2A illustrates of a side view of a mechanism used for allowing both elliptic and circular motion, in accordance with an exemplary embodiment of the disclosed subject matter.

FIG. 2A schematically illustrates a side view of a mechanism 200 enabling both elliptic and circular movement of a footrest within an exercising device, in accordance with an exemplary embodiment of the disclosed subject matter. The mechanism comprises a main wheel 230 and a connecting rod 210 connected to main wheel 230. The proximal end of connecting rod 210 is connected to body 150 of exercising device 100 and the distal end of connecting rod 210 is connected to main wheel 230.

The distal end of connecting rods 210, 215 resides on a non-centric point on main wheels 230, 260, respectively. Such distal ends, for example point 213 of FIG. 3, move circularly when the user pushes the pedals. Since the proximal end of resides firmly on body 150 or on another secured element of exercising device 100, change in the location of the distal points on main wheels 230, 260 forces change in the location of main wheels 230, 260. For example, when the location of a distal point is in the far most point from the proximal end, the main wheel is forced to move towards the proximal end. Such movement of the main wheels is limited to horizontal movement due to a mechanical track or other elements than can be appreciated by a person skilled in the art. When the user generates circular movement of main wheel 230 by rotating footrest 160, and horizontal movement of main wheel 230 is generated since the location of the distal end of connecting rod 210 on main wheel 230 changes, the movement of footrest 160 connected to main wheel 230 is elliptical. When disconnecting connecting rod 210 from main wheel 230, or disconnecting the proximal end of connecting rod 210 from the exercising device 100, the horizontal movement of main wheel 230 terminates, and the range of movement of footrest 160 connected to main wheel 230 is circular. In an alternative embodiment, the circular movement of main wheel 230 is performed when positioning the distal end of connecting rod 210 in the center of main wheel. Combining a main wheel 230 connected to footrest 160 and connecting rod 210 generating the horizontal movement of main wheel 230 enables both circular and elliptical movement of footrests 160, 162.

In an exemplary embodiment of the disclosed subject matter, exercising device 100 comprises two pairs of synchronized wheels; each pair is associated with each footrest of footrests 160, 162. Main wheel 230 is connected to secondary wheel 240. Similarly, on the other side of the exercising device 100, main wheel 260 is connected to secondary wheel 250. One footrest used for exercising is connected to each main wheel. Moving the footrest rotates the associated main wheel. In one exemplary embodiment of the subject matter, each main wheel 230, 260 is connected to a separate connecting rod 210, 215 which forces horizontal movement of the relevant main wheel 230, 260 according to the location of the distal end of the connecting rods 210, 215 on main wheels 230, 260.

Secondary wheels 240, 250 are both connected by a rod (245 of FIG. 2B) and limited to vertical movement. Each secondary wheel is connected to an associated main wheel using a gear, strap or rod (237 of FIG. 2C) connected to the centers of both main wheel and secondary wheel. Thus, for example, the distance between the center of main wheel 230 and the center of secondary wheel 240 is constant. The height of secondary wheels 240 and 250 is equal since a rod connects both wheels limits their movement.

In an exemplary embodiment of the subject matter, the center of the range of the horizontal movement of main wheels 230, 260 is located where the two centers of main wheels 230, 260 are closest. When connecting rod 210 forces main wheel 230 away from the center of the range of movement, secondary wheel 240 connected to main wheel 230 moves downwards. Similarly, secondary wheel 240 moves upwards when connecting rod 210 moves main wheel 230 closer to the center of the range of movement. While main wheel 230 distances from the center of the range of movement, secondary wheel 240 moves downwards and forces secondary wheel 250 downwards since the rod (245, shown in FIG. 2B) connecting both secondary wheels 240, 250 keeps said secondary wheels in substantially the same height. As a result, main wheel 260 moves away from the center of the range of movement. When main wheel 260 moves horizontally, the distance between the center of main wheel 260 and the proximal end of connecting rod 215 is changed. As a result, the location of the distal end of connecting rod 215 on main wheel 260 is forced to change, and circular movement of main wheel 260 is generated. This way, when one main wheel circulates, the other main wheel is forced to perform circular movement and both main wheels 230, 260 are synchronized. Further, the number of rounds per minute of both main wheels 230, 260 is required to be equal. This is achieved by having to main wheels 230, 260 having the same size, and secondary wheels 240, 250 having the same size.

The user determines the velocity, frequency, and amplitude of the movement of connecting rod 210 using control unit 140 of exercising device 100. For example, the amplitude may be limited mechanically by a rod or spring connected to the connecting rod. Alternatively, a switch or a button in the control unit limits the amplitude by transmitting a command to the power-generating module 225 moving the connecting rod. Controlling the amplitude is optionally provided by changing the distance of the distal end of connecting rods 210, 215 from the center of main wheels 230, 260. As explained in FIG. 3, no amplitude is achieved when the distal end is located in the center of main wheels 230, 260, and the maximal amplitude is achieved when the distal end resides on the perimeter of main wheels 230, 260.

Figure 2B:
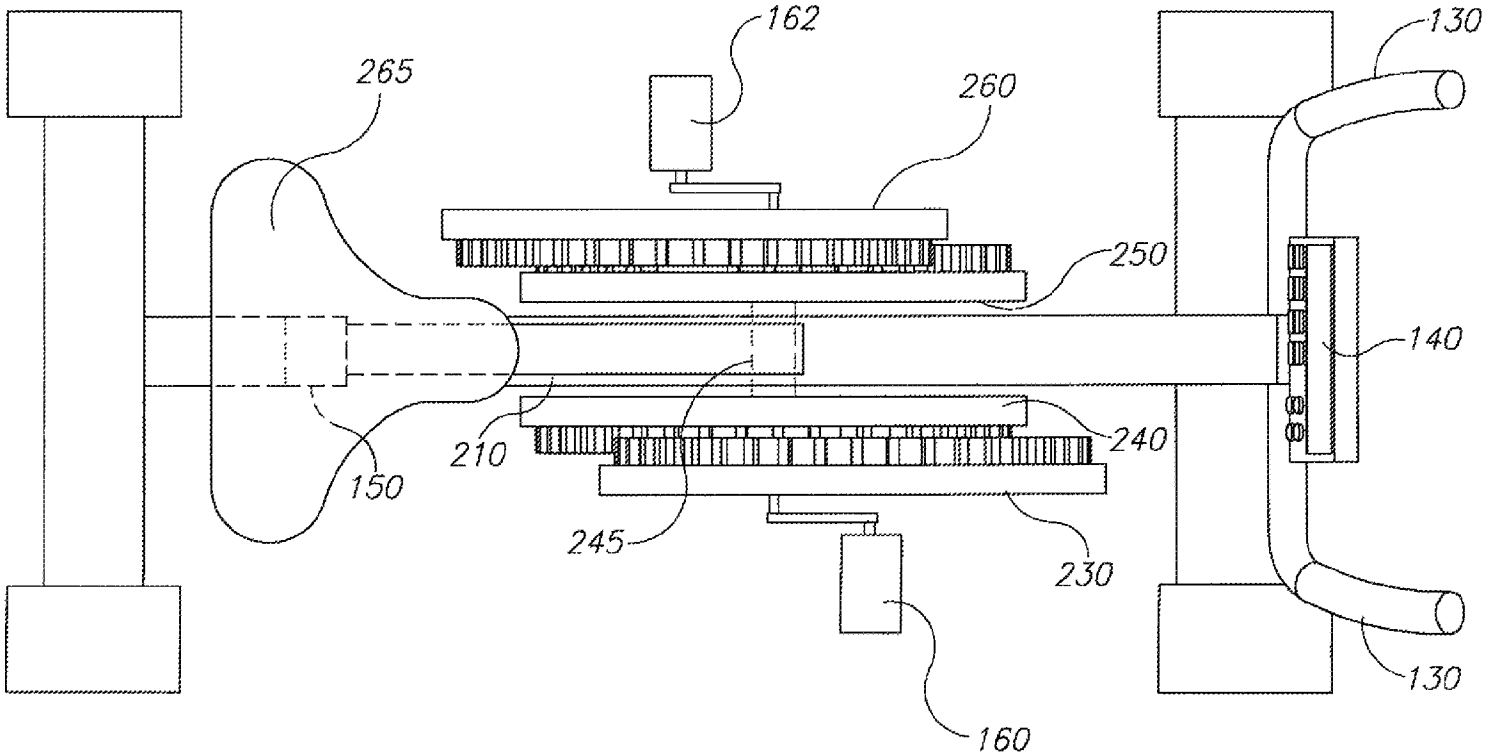
FIG. 2B illustrates a top view of a mechanism used for allowing both is elliptic and circular motion, in accordance with an exemplary embodiment of the disclosed subject matter.

FIG. 2B schematically illustrates a top view of a mechanism 200 used for enabling both elliptic and linear motion of a footrest moved by a user of an exercising device, in accordance with an exemplary embodiment of the disclosed subject matter. Mechanism 200 comprises connecting rods 210, 215 connected to body 150 or connected to an element associated with body 150 on its proximal end and to main wheels 230, 260 on its distal end. Each main wheel of 230, 260 is located on opposite side of seat 265. For example, main wheel 230 is on the right side of seat 265 and main wheel 260 is on the left side of seat 265. In an exemplary embodiment of the disclosed subject matter, an element associated with body 150 limits the range of movement of connecting rods 210, 215 to the horizontal axis. Such element may be a niche, a mechanical track, defining walls and the like. Connecting rods 210, 215 are preferably connected to a non-centric point of main wheels 230, 260, such that when footrests 160, 162 are rotated by the user, the location of the distal ends of connecting rods on the main wheels 230, 260 changes. As a result, the distance between the proximal ends of connecting rods 210, 215 and the center of main wheels 230, 260 is forced to change, since the distance between the proximal end and a distal end of each connecting rod is constant.

In a preferred embodiment of the subject matter, main wheel 230 is connected to secondary wheel 240 for synchronizing the movement of main wheels 230, 260. Secondary wheel 240 is connected to secondary wheel 250. The size of a secondary wheel is not required to be the same as the size of a main wheel. For example, main wheel 230 may rotate 720 degrees while secondary wheel 240 rotates only 360 degrees. Synchronization between the two pedals is provided by secondary wheels 240 and 250. When the user moves a first footrest, the main wheel is moved respectively. For example, main wheel 230 is moved. Secondary wheel 240 moves according to the movement of main wheel 230. The main wheels 230, 260, and secondary wheels 240, 250 move circularly, both when the movement of footrests 160 connected to main wheels 230, 260 is circular and elliptical.

When the exercising device is in a bicycle mode, the main wheels 230, 260 are not moved on the horizontal axis, the movement of footrests 160, 162 generates circular movement of the main wheels 230, 260. In an exemplary embodiment of the subject matter, each pair of a main wheel and a secondary wheel is connected such that circular movement of the main wheel generates circular movement of the secondary wheel. Similarly, circular movement of a secondary wheel generates circular movement of a main wheel connected thereto. This synchronized circular movement is preferably achieved by connecting each pair of a main wheel and a secondary wheel using a cogwheel, a strap wheel, a rod connecting both wheels and any other device or technology achieved by a person skilled in the art.

Secondary wheels, 240 and 250 are interconnected by rod 245, to generate circular movement of one secondary wheel by circular movement of the other secondary wheel. Rod 245 may be connected to the centers of both secondary wheels 240, 250. Alternatively, rod 245 is split in at least one end to a plurality of poles, each pole is connected to another point in a secondary wheel, to maintain synchronization of the movement of both secondary wheels 240, 250. The circular movement of secondary wheel 250 generates circular movement of main wheel 260, so both footrests 160, 162 connected to main wheels 230 and 260 are synchronized using the secondary wheels 240, 250. This synchronization mechanism achieved by secondary wheels 240, 250 may be used both in the elliptical and circular movements of the footrests 160 and avoids the need of a connecting rod connecting main wheels 230, 260 or footrests 160, 162 as used in a regular bicycle mode.

Figure 2C:
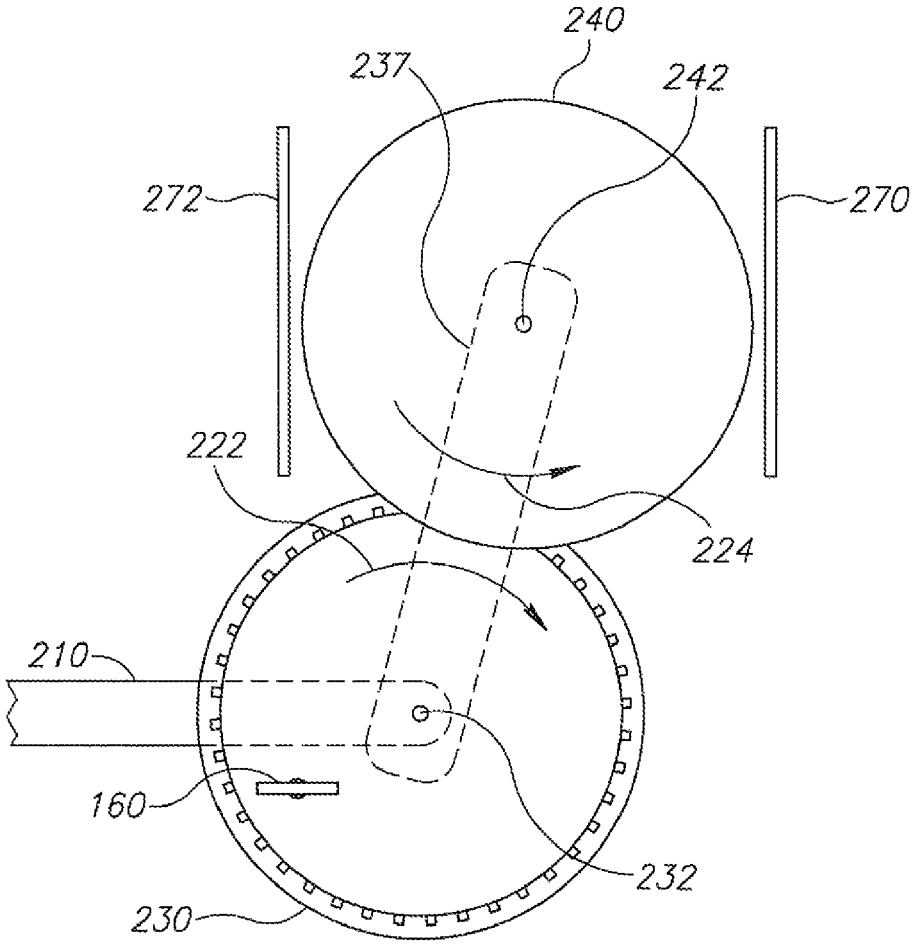
FIG. 2C illustrates a main wheel, a secondary wheel, and the relations thereof, in accordance with an exemplary embodiment of the disclosed subject matter.

FIG. 2C illustrates a main wheel, a secondary wheel, and the relations thereof, in accordance with an exemplary embodiment of the disclosed subject matter. Main wheel 230 may be connected to secondary wheel 240 using a cogwheel mechanism, or using a rod 237 connected on one end to the center 232 of main wheel 230 and on the other end to the center 242 of secondary wheel 240. In the exemplary embodiment in which both main wheel 230 and secondary wheel 240 are cogwheels, the circular movement of the main wheel 230 caused by the user moving footrests 160, 162 generates circular movement of secondary wheel 240. The direction of the circular movement of main wheel 230 is shown in arrow 222 and the direction of the circular movement of secondary wheel 240 is shown in arrow 224. The circular movement of secondary wheel 240 forces circular movement of secondary wheel 250 (not shown in FIG. 2C), connected to main wheel 260 (not shown in FIG. 2C) and forces circular movement of main wheel 260. Secondary wheels 240, 250 may be restricted to vertical movement by walls 270, 272. Alternatively, a niche or a mechanical track (not shown) restricts secondary wheels 240, 250 to vertical movement. Hence, for example, when main wheel 230 is moved towards the handlebars, away from wall 272, secondary wheel 240 moves downwards and the distance between center 232 of main wheel 230 and center 242 of secondary wheel 240 remains constant.

Figure 3A:
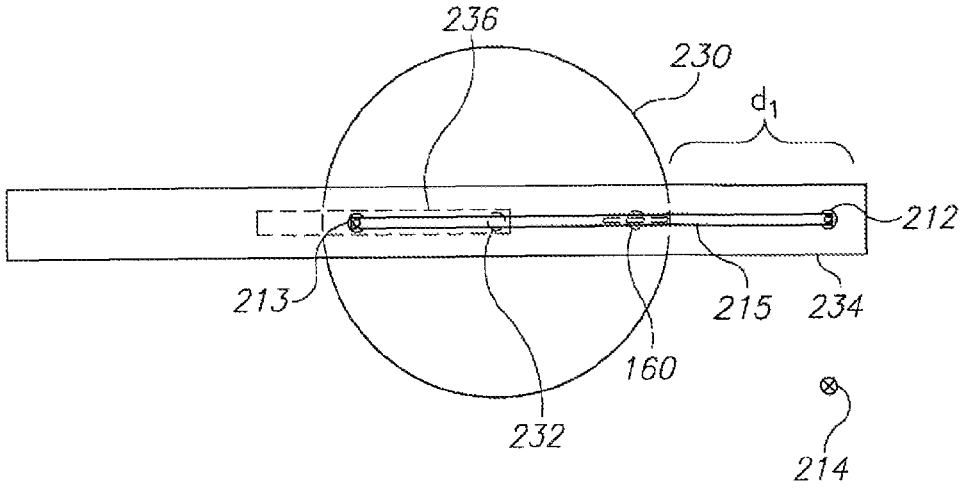
FIGS. 3A, 3B illustrate a main wheel and two positions of the mechanism enabling elliptical movement of the footrest, in accordance with an exemplary embodiment of the disclosed subject matter.
Figure 3B:
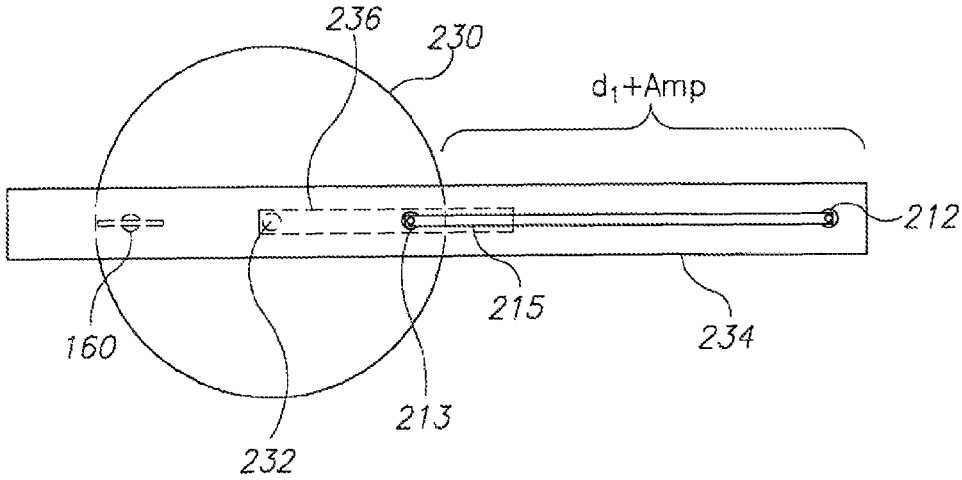

FIGS. 3A, 3B illustrate a main wheel and two positions of the mechanism enabling elliptical movement of the footrest, in accordance with an exemplary embodiment of the disclosed subject matter. Main wheel 230 rotates in circular motion when the user is moving footrest 160. Connecting rod 215 is connected to main wheel 230 at distal end 213. Proximal end 212 of connecting rod 215 is connected to body 150 (not shown) or to pole 234. In an exemplary embodiment of the subject matter, distal end 213 is located substantially on the same diameter of the main wheel 230 as the footrest 160. As a result, when the location of the footrest 160 changes by the user's pedaling, the location of distal end 213 on main wheel 230 changes. Since proximal end 212 is fixed, and the distance between the proximal end 212 and distal end 213 is constant, the change in the location of distal end 213 on main wheel 230 forces horizontal movement of main wheel 230. The lateral movement of main wheel 230 is restricted by niche 236, therefore main wheel 230 may only move along axis x. Axis x would typically be located along a horizontal axis spanning from the front to the back of the exercise device (100 of FIG. 1).

For example, as shown in FIG. 3A, when the distance between proximal end 212 and footrest 160 increases, as a result of the circular movement of footrest 160 on main wheel 230, main wheel 230 horizontally moves away from the proximal end 212. This is achieved since the distance between distal end 213 and proximal end 212 is constant, and the rotation of main wheel 230 changes the location of distal end 213 on main wheel 230. Similarly, movement of main wheel 230 towards proximal end 212 is provided when the distance between footrest 160 and proximal end 212 is decreased. The movement of main wheel 230 towards proximal end 212 is also shown when the distance between center 232, located within the range of niche 236, is relatively close to proximal end 212. When the user wishes to change the amplitude of the horizontal movement manually, he may change the location of distal end 213 on main wheel 230. When exercising device 100 comprises a power-generating module, controlling the amplitude of the movement of main wheel 230 may also be provided electrically, as the user presses a button or a switch in the control unit 140 that transmits a command to a receiving unit residing in the power-generating module that generates horizontal movement of the wheel. The command may be received at a remote computerized location and then transmitted to the power-generating module connected to the to main wheel.

The amplitude of the horizontal movement of main wheel 230 increases when distal end 213 is located closer to the perimeter of main wheel 230. The amplitude can also be controlled mechanically or electronically by power-generator device 225 changing the distance between distal point 213 and center 232. As described in details in FIGS. 6A, 6B, the elliptical movement of footrests 160, 162 may be synchronized with the horizontal movement or non-synchronized. When the proximal point resides on substantially the same height as center 232, for example in proximal end 212, the circular movement and horizontal movement are synchronized. Optional point 214 suggests an alternative location of proximal end of connecting rod 210, when the user wishes to generate non-synchronized elliptical movement as disclosed in FIG. 6B. in accordance with another exemplary embodiment of the disclosed subject matter, distal end 212 is not located on the same diameter line on main wheel 230 as footrest 160, or may be mounted or positioned also on another location on main wheel that resides on a diameter other than the diameter including the location of footrest 160. Such location may also provide the range of movement shown on FIG. 6B.

FIG. 3B shows the mechanism when the distance between footrest 160 and proximal end 212 is substantially the maximal distance, and the main wheel 230 is moved away from proximal end 212. In such case, distal end 213 is located between center 232 and proximal end 212. In an exemplary embodiment of the disclosed subject matter, the proximal end 212 is located in the backward portion of the exercising device, in the vicinity of seat 265 of FIG. 2A. In such case, when the footrest 160 is located in the backward portion of the main wheel 230, main wheel 230 is moved backwards since distal end 213 is located in the forward portion of main wheel 230. Hence, the lateral horizontal movement of main wheel 230 is synchronized with the rotational movement of the wheel caused by the user. In another exemplary embodiment of the subject matter, both circular movement of footrest 160 and the horizontal movement are synchronized using an electronic detecting device or power-generating device 225 for accurate operation of mechanism 120. The requirement for constant distance between distal end 213 and proximal end 212 while the location of distal end 213 on main wheel 230 changes according to the user's pedals enables full synchronization between the horizontal and circular movements.

Figure 4:
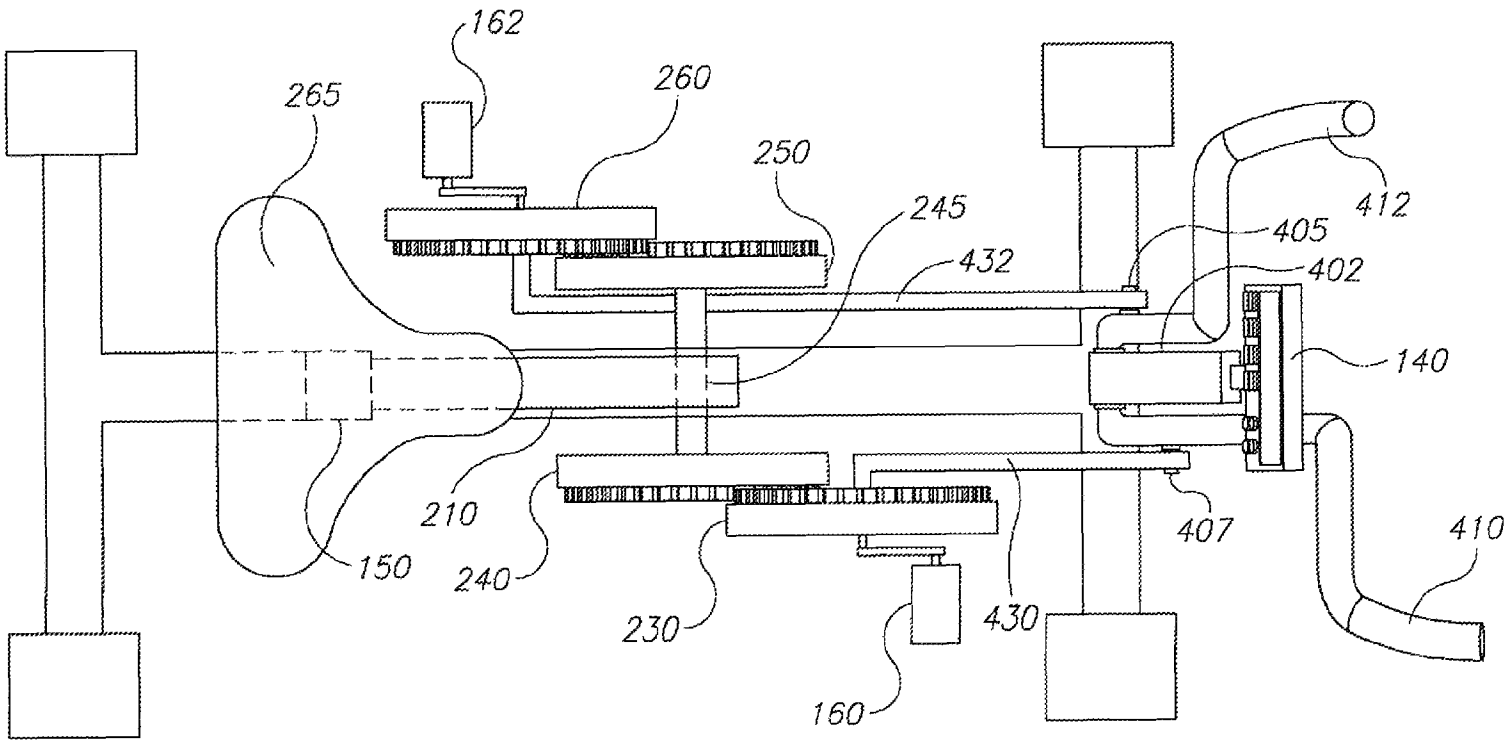
FIG. 4 is an illustration of a handlebar used for various aerobic types of exercising, in accordance with an exemplary embodiment of the disclosed subject matter.

FIG. 4 schematically illustrates a top view of exercising device 100 is comprising a handlebar mechanism used for various aerobic types of exercising, in accordance with an exemplary embodiment of the disclosed subject matter. Handlebars 410, 412 are required to fit the various exercising types performed in the exercising device 100 of the subject matter. Body 150 of exercising device 100 is connected to control unit 140. Body 150 is preferably connected to the mechanism 120 controlling the movement of footrests 160, 162. Footrest 160 is connected to main wheel 230, and footrest 162 is connected to main wheel 260.

According to one exemplary embodiment of the subject matter, handlebars 410, 412 may be in a firm state, preferably in case the user utilizes exercising device 100 in bicycle mode and wishes to hold handlebars 410, 412 firmly. Handlebars 410, 412 may also be in the free state and move according to the movement of footrests 160, 162, respectively. The free state is achieved using rods 430, 432 connected to main wheels 240, 250 on one end and to handlebars 410, 412 on the other end. For example, movement forward of main wheel 230 generated using connecting rod 210 generates movement of rod 430 that generates movement of handlebar 410 in approximately the same direction as the direction of main wheel 230. Similarly, movement backward of main wheel 260 generated using connecting rod 215 generates movement of rod 432 that generates movement of handlebar 412 in approximately the same direction as the direction of main wheel 260.

In one exemplary embodiment of the subject matter, the movement of handlebars 410, 412 is disabled when exercising device is in firm state. Disabling the movement handlebars 410, 412 may be performed by opening two joints 405, 407 located between handlebars 410, 412 and the middle portion 402 of body 150. When joints 405, 407 are locked, the movement of handlebars 410, 412 is disabled. Alternatively, rods 430, 432 may be disconnected from main wheels 230, 260 such that main wheels 230, 260 are not connected to handlebars 410, 412 and movement of main wheels 230, 260, do not generate movement of the handlebars 410, 412. Alternatively, rods 430, 432 may be disconnected from handlebars 410, 412 to achieve disablement. Enabling and disabling movement of handlebars 410, 412 using joints 405, 407 may be performed manually by the user, or electrically using control unit 140.

Alternatively, rods 430, 432 are removable and may be removed when the user desires no movement of the handlebars 410, 412. In other embodiments of exercising device 100, control unit 140 can control the movement of handlebars 410, 412. For example, a switch or button in control unit 140 may activate or prevent movement of one or more handlebars 410, 412, mechanically or electronically.

Figure 5A:
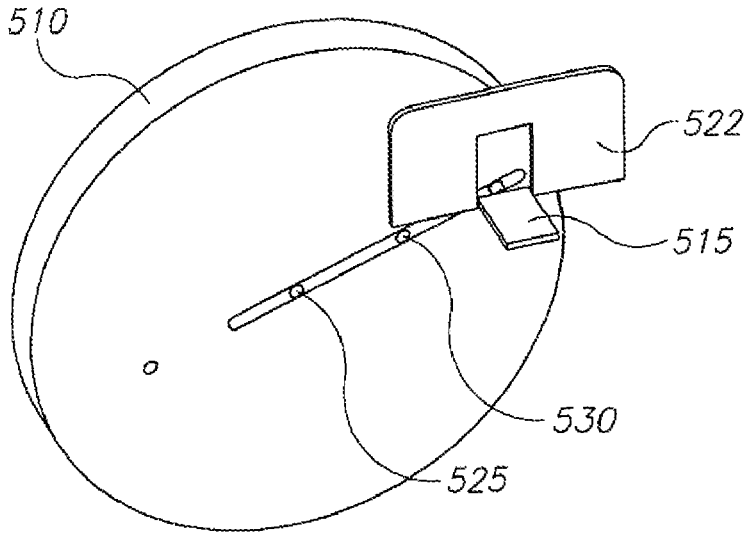
FIG. 5A illustrates a footrest mechanism used for various aerobic types of exercising in a closed position, in accordance with an exemplary embodiment of the disclosed subject matter.

Referring to FIG. 5A, schematically illustrates a pedal mechanism used for various aerobic types of exercising in a closed position, in accordance with an exemplary embodiment of the disclosed subject matter. Pedal mechanism is connected to the center 525 of a main wheel 510 using a rod 530. Pedal mechanism 500 consists of two elements, central footrest 522 and minor footrest 515. Minor footrest 515 is parallel to the ground such that the user is constantly provided with a footrest to position his foot. Central footrest 522 has two positions—open position and closed position. When central footrest 522 is in closed position, central footrest 522 is positioned parallel to the surface of main wheel 510, and the user can place his foot on minor footrest 515. In an exemplary embodiment of the subject matter, the closed position of central footrest 522 is adapted to use exercising device 100 for biking.

Figure 5B:
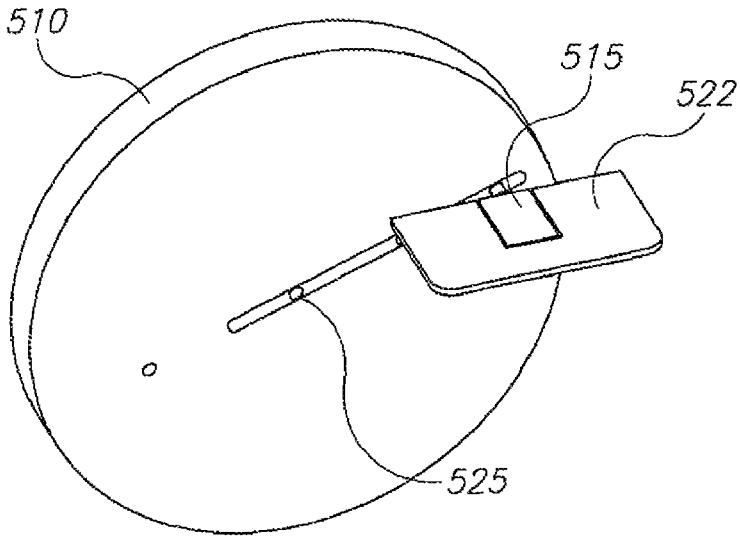
FIG. 5B illustrates a footrest mechanism used for various aerobic types of exercising in an open position, in accordance with an exemplary embodiment of the disclosed subject matter.

FIG. 5B illustrates a footrest mechanism used for various aerobic types of exercising in an open position, in accordance with an exemplary embodiment of the disclosed subject matter. In one exemplary embodiment of the open position, central footrest 522 is positioned in parallel to the ground. In another embodiment of the open position, central footrest 522 is positioned in the same surface as minor footrest 515, thus enlarging the surface on which the user mounts his feet. Switching between open position and closed position may be performed manually or any other way performed by the user maneuvering central footrest 522. in an alternative exemplary embodiment, a power generating device such as power-generating module 225 is provided to maneuver central footrest 522 according to the exercise or the exercising program of the user.

In accordance with an alternative embodiment of the subject matter, a lock (not shown) is utilized to lock central footrest 522 in the closed position. In another exemplary embodiment of the disclosed subject matter, pedal mechanism 500 is composed of two or more parallel surfaces. When pedal mechanism 500 is required to decrease its surface area, at least one of the two or more parallel surfaces is folded and mounted on top or beneath the other surface, thereby decrease the surface area. For example, when central footrest 522 is in closed position, it is mounted on or beneath minor footrest 515. In an exemplary embodiment of the subject matter, the two or more parallel surfaces are interconnected by a rotation axis (not shown).

Figure 6A:
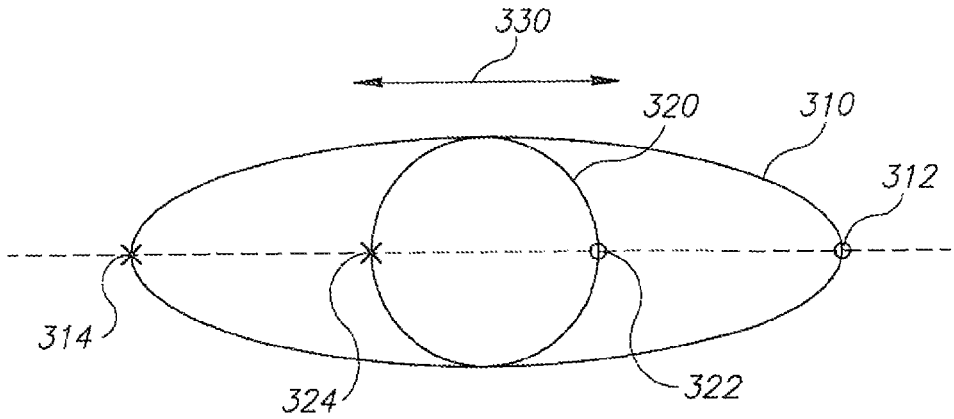
FIGS. 6A and 6B illustrate various kinds of movements enabled using the mechanism, in accordance with an exemplary embodiment of the disclosed subject matter.
Figure 6B:
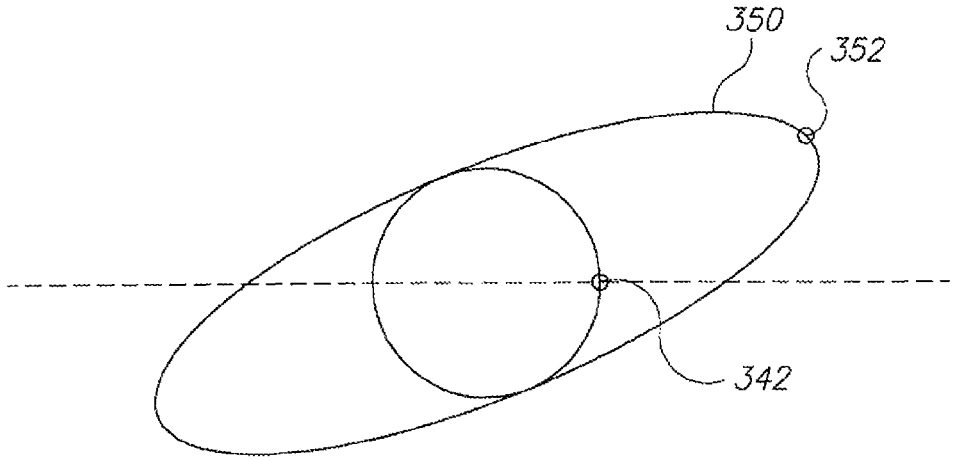

FIGS. 6A and 6B schematically illustrate various kinds of movements uniquely enabled using exercising device 100, in accordance with an exemplary embodiment of the disclosed subject matter. FIG. 6A discloses a circular course 320 required when the user uses the exercising device as a stationary bicycle exercise device, and a linear course 330 combined with circular course 320 to generate elliptical course 310. The mechanism 200 disclosed in FIG. 2 enables separate control on the linear course 330 of the main wheels 230, 260 preferably generated by connecting rod 210 and the circular course 320 applied on exercising device 100. As a result, various types of movement are enabled in one device and various exercises may be performed, such as biking, skiing, using the exercising device 100 as an elliptical device, and the like.

FIG. 6A also shows elliptical course 310 as required when using exercising device 100 of the subject matter as an elliptical or stepper. In general, elliptic movement is generated when circular course 320 is added to linear course 330. For example, when moving the main wheels 230, 260 in linear course 330 in addition to circular course 320 caused by the user moving footrests 160, 162, footrests 160, 162 located in point 322 within circular course 320 are advanced to point 312 within elliptical course 310. Similarly, when footrest 160 is located in point 324 in main wheel 230, footrest 160 is shifted by linear movement and located in point 314 within elliptical course 310. The linear movement causes the offset between point 324 and point 314. In FIG. 3A, the linear movement is in its right most point in the exact time point 322 is in the writ-right most point in elliptical course 310. Hence, the footrests 160, is in the right most point of the main wheel 230 when the main wheel 230 is in the right most point of its linear course 330.

FIG. 6B describes an optional course of movement used when the linear course 330 of main wheel 230 is not in phase with the movement of footrest 160. In a synchronous system, when the footrest 160 is in the most forward point, the main wheel 230 is forced to move by the connecting rod 210 to the most forward point, preferably the closest point to the handlebars. Similarly, when the footrests 160 is in the back most point in main wheel 230, the main wheel 230 located in its back most point, preferably.

When the horizontal movement of main wheel 230 and the circular movement of footrest 160 within main wheel 230 are not synchronized, the footrest 160 is located in the topmost point of main wheel 230 when main wheel 230 is not located in the center of its linear course 330. Similarly, when footrests 160 is in the most forward point of main wheel 230, as shown in point 342, the main wheel 230 slightly moves forward such that point 352 in elliptical course 350 is not located in the most forward point.

Hence, the shape of elliptical course enabled via the described mechanism is different from the standard elliptical course enabled by the known elliptical devices known in the art. The exercising device of the subject matter enables circular course, as well as various elliptical courses, as shown in elliptical courses 310 and 350. Elliptical course 350 is useful for a stepper and for working on a to group of muscles different from the muscles built when exercising in elliptical course 310.

In one exemplary embodiment of the subject matter, the different phased elliptical course 350 may be provided by changing the location of the proximal end of the connecting rod. This step changes the shape and timing of the movement of the main wheel relative to the movement of the footrests 160, 162. In an alternative exemplary embodiment of the subject matter, the different phased elliptical course 350 is provided electrically. In such case, control unit 140 receives a command from the user and transmits the command to a controller connected to power-generating module 225. Power-generating module 225 may decrease the velocity of the horizontal movement generated using connecting rods 210, 215 for a predetermined period of time, or change the amplitude of the horizontal movement.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. An exercising device, comprising:

a body;

two main wheels, each connected to a different footrest;

two connecting rods, each of the two connecting rods is connected on a first end to the body of the exercising device and to one of the two main wheels on a second end;

each of the two connecting rods is connected to a single point on one of the two main wheels, such that the each of the two main wheels moves around the single point;

wherein the course of the footrest's movement is elliptical when the single point connecting each of the two connecting rods to each of the two main wheels is a non-centric position on the main wheels and circular when the single point connecting each of the two connecting rods to each of the two main wheels is a centric position on the main wheel wherein the movement of the footrests is elliptical when the two main wheels are moved on a horizontal axis and circular when the two main wheels are not moved on the horizontal axis.

2. The exercising device according to claim 1, further comprising a control unit for controlling the movement of the two connecting rods.

3. The exercising device according to claim 2, wherein the control unit determines parameters selected from a group consisting of the amplitude, velocity, frequency and phase of the movement of the two connecting rod.

4. The exercising device according to claim 1, further comprising two interconnected secondary wheels, each secondary wheel is limited to vertical movement and connected to a different main wheel, wherein both secondary wheels are in the same height.

5. The exercising device according to claim 4, wherein the two interconnected secondary wheels affix the two main wheels in the same distance from the center of the range of the horizontal movement of the main wheels.

6. The exercising device according to claim 1, further comprises an element for limiting a range of movement of the two connecting rods on the horizontal axis.

7. The exercising device according to claim 1, wherein the two main wheels obtain a center, and wherein the distance between the footrests and the center of each of the two main wheels is constant.

8. An exercising device, comprising:

a body;

two main wheels, each connected to a different footrest;

two connecting rods, each of the two connecting rods is connected on a first end to the body of the exercising device and to one of the two main wheels on a second end;

each of the two connecting rods is connected to a single point on one of the two main wheels, such that the each of the two main wheels moves around the single point;

wherein the course of the footrest's movement is elliptical when the single point connecting each of the two connecting rods to each of the two main wheels is a non-centric position on the main wheels and circular when the single point connecting each of the two connecting rods to each of the two main wheels is a centric position on the main wheel; and wherein an amplitude of the horizontal movement of the two main wheels is zero when each of the two connecting rods is connected to the centric position on the main wheel.

* * * * *